US006257012B1

(12) United States Patent
Tesche et al.

(10) Patent No.: US 6,257,012 B1
(45) Date of Patent: Jul. 10, 2001

(54) FAN SCROLL ASSEMBLY FOR THE INDOOR UNIT OF AN AIR CONDITIONER

(75) Inventors: Carlos Alfonso Tesche, Canoas; Juan Carlos Carne Correa, Porto Alegre, both of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/485,752

(22) PCT Filed: Jun. 22, 1998

(86) PCT No.: PCT/BR98/00039

§ 371 Date: Feb. 15, 2000

§ 102(e) Date: Feb. 15, 2000

(87) PCT Pub. No.: WO99/67581

PCT Pub. Date: Dec. 29, 1999

(51) Int. Cl.[7] ..... F25D 19/00; F01D 25/24

(52) U.S. Cl. ..... 62/298; 415/204; 415/214.1

(58) Field of Search ..... 62/258, 298; 415/203, 415/204, 206, 214.1; 454/355; 248/672

(56) References Cited

U.S. PATENT DOCUMENTS

| | | | | |
|---|---|---|---|---|
| 4,672,819 | | 6/1987 | Mino et al. . | |
| 5,158,432 | * | 10/1992 | Cox | 415/214.1 |
| 5,403,163 | | 4/1995 | Murphy . | |
| 5,638,693 | * | 6/1997 | Baek | 62/298 X |
| 5,690,470 | * | 11/1997 | Zimmer | 415/214.1 |
| 5,743,721 | * | 4/1998 | Graham et al. | 415/206 X |

FOREIGN PATENT DOCUMENTS

WO9826228 6/1998 (WO) .

* cited by examiner

*Primary Examiner*—Michael Powell Buiz
*Assistant Examiner*—Chen-Wen Jiang

(57) ABSTRACT

A scroll housing (40) is provided for enclosing a centrifugal fan of an air distribution unit. The housing (40) is of the type configured for mounting to a panel (22) dividing the air distribution unit into inlet and outlet regions. The scroll housing (40) is formed from two sections (50, 52). A rear section (50) includes a curved wall (56) having a first edge (58) at one end thereof, which defines one side of the rectangular opening (39), and a second edge (60) at the other end of the wall (56). A front section (52) of the scroll housing also includes a curved wall (96) having a first edge (98) at one end thereof, which defines the fourth side of the rectangular opening (39) and a second edge (100) of the other end thereof. The second edge (60) of the curved wall (56) of the back section (50) is provided with a first hinge element (70) thereon. The second edge (100) of the curved wall (96) of the front section (52) is provided with a second hinge element (110) thereon. The side walls (62, 64) of the back section (50) have latching conformations (88) formed thereon at a location underlying the first edge thereof and above the semi-circular opening therein. The side walls (102) of the front section (52) have a latching conformation formed thereon in the first edge, which are adapted to positively engage the latching conformations on the back section (50) when the sections are pivoted toward one another about the hinge engagement.

3 Claims, 8 Drawing Sheets

FAN SCROLL ASSEMBLY FOR THE INDOOR UNIT OF AN AIR CONDITIONER

TECHNICAL FIELD

The invention generally relates to air distribution units of the type commonly used in air conditioning, heating or ventilation systems and, more particularly, to a two-piece scroll assembly for the indoor fan of such a unit.

BACKGROUND ART

In many commercial air conditioning, heating and ventilating systems, treated air is discharged into an area to be conditioned through an air distribution or conditioning unit. For example, one general type of air conditioning system, often referred to as a split system, includes separate indoor and outdoor units. The outdoor unit includes a compressor, a heat exchanger and a fan. The indoor unit includes a heat exchanger and a fan. In operation, the indoor fan draws air into the indoor unit, through an inlet thereof, and forces the air over the indoor heat exchanger and then out of the indoor unit, through an outlet opening therein.

The outdoor fan draws air into the outdoor unit, through an inlet, forces that air over the outdoor heat exchanger and then forces that air out of the outdoor unit through an outlet therein. At the same time, a compressor causes a refrigeration fluid to circulate through and between the indoor/outdoor heat exchangers. At the indoor heat exchanger, the refrigerant absorbs heat from the air passing over that heat exchanger, cooling that air. At the same time, at the outdoor heat exchanger, the air passing over the heat exchanger absorbs heat from the refrigerant passing therethrough.

Split type air conditioning units of this type are typically manufactured in a wide range of cooling capacities. Accordingly, the size of the indoor unit can range from a small compact relatively narrow unit up to a wide unit, of substantially the same height as the compact unit. Typically the larger units will include a plurality of air circulating fans.

Typically, the larger the unit the more components are required and the more fasteners are required in order to assembly all of the components. It is considered extremely desirable to minimize the number of components required in order to fabricate the indoor units of such an air conditioning system. One component of such indoor units which typically comprises many components and fastening means is the fan scroll structure for housing the indoor unit fans and directing the air through the unit as described above.

DISCLOSURE OF THE INVENTION

A scroll housing is provided for enclosing a centrifugal fan of an air distribution unit. The housing is of the type configured for mounting to a panel dividing the air distribution unit into inlet and outlet regions. The panel has a rectangular air flow opening formed therein. The scroll housing generally defines an irregular cylinder having end walls with circular inlet openings therein and a rectangular opening configured to be in air flow communication with the rectangular opening in the panel. The scroll housing is formed from two sections. A rear section includes a curved wall having a first edge at one end thereof, which defines one side of the rectangular opening, and a second edge at the other end of the wall. The first and second edges are substantially parallel to one another. The back section further includes planar end walls on opposite sides, each of which has a first edge which intersects with and is substantially perpendicular to the first edge of the curved wall to thereby define lateral sides of the rectangular opening. A second edge of the side wall intersects with the second edge of the curved wall. The planar end wall further includes a semi-circular opening forming half of the circular inlet opening. A front section of the scroll housing also includes a curved wall having a first edge at one end thereof, which defines the fourth side of the rectangular opening and a second edge of the other end thereof. The front section further includes planar end walls on opposite sides of the curved wall. Each of the end walls has a first edge perpendicularly intersecting with the first edge of the curved wall, and a second edge which intersects with and is substantially perpendicular to the second edge of the curved wall. Each end wall includes a semi-circular opening forming half of the circular inlet opening. The second edge of the curved wall of the back section is provided with a first hinge element thereon. The second edge of the curved wall of the front section is provided with a second hinge element thereon. The first and second hinge elements are configured to engage one another to interconnect the second edges of the front and back sections and allow pivotal movement of the said sections with respect to one another. The side walls of the back section have latching conformations formed thereon at a location underlying the first edge thereof and above the semi-circular opening therein. The side walls of the front section have a latching conformation formed thereon in the first edge, which are adapted to positively engage the latching conformations on the back section when the sections are pivoted toward one another about the hinge engagement.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
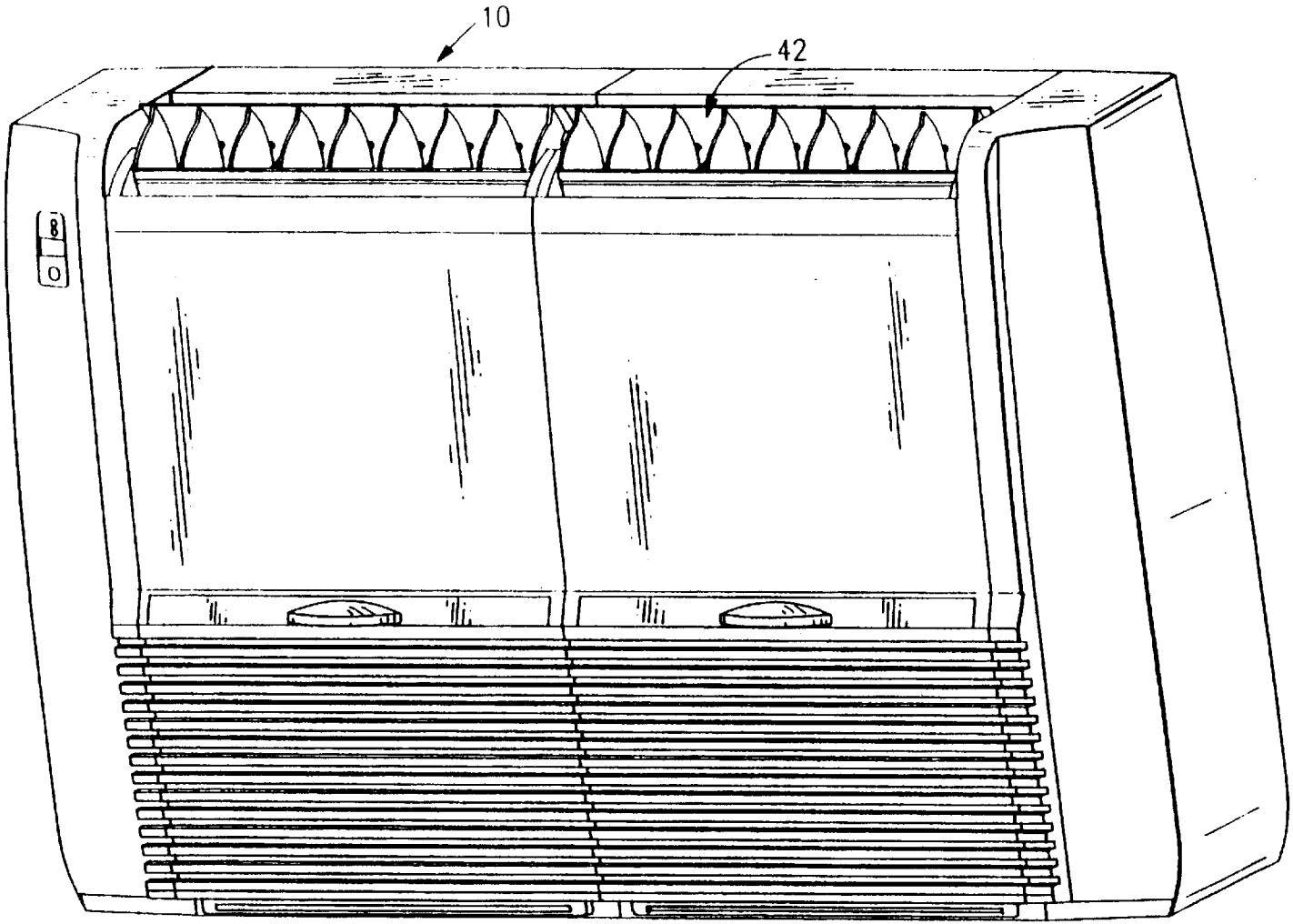
FIG. 1 is a perspective view of the indoor unit of an air conditioner which embodies the features of the present invention.
Figure 2:
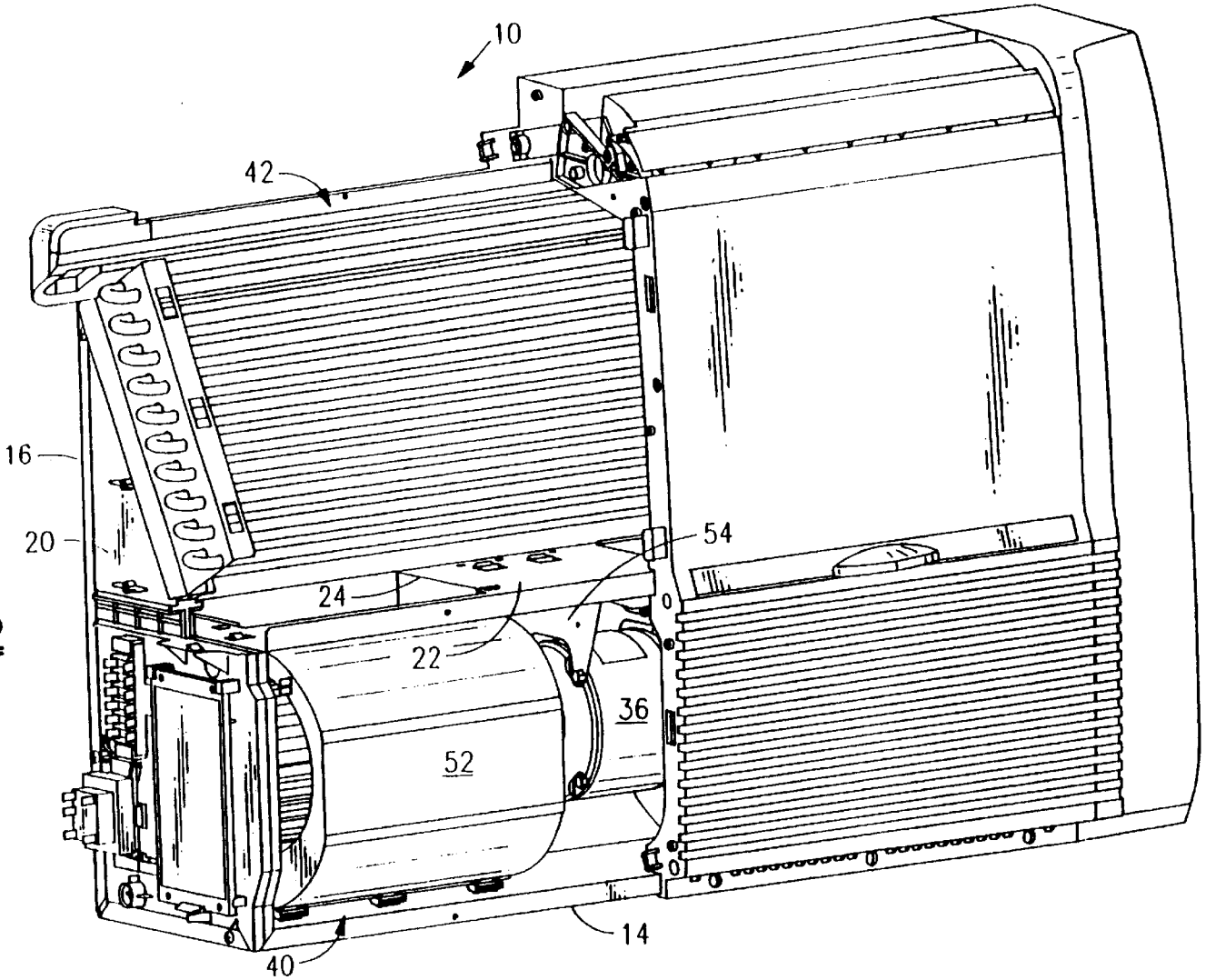
FIG. 2 is a perspective view of the air conditioning unit of FIG. 1, with the left-hand side cover, and one of the modular front panel sections removed therefrom.
Figure 8:
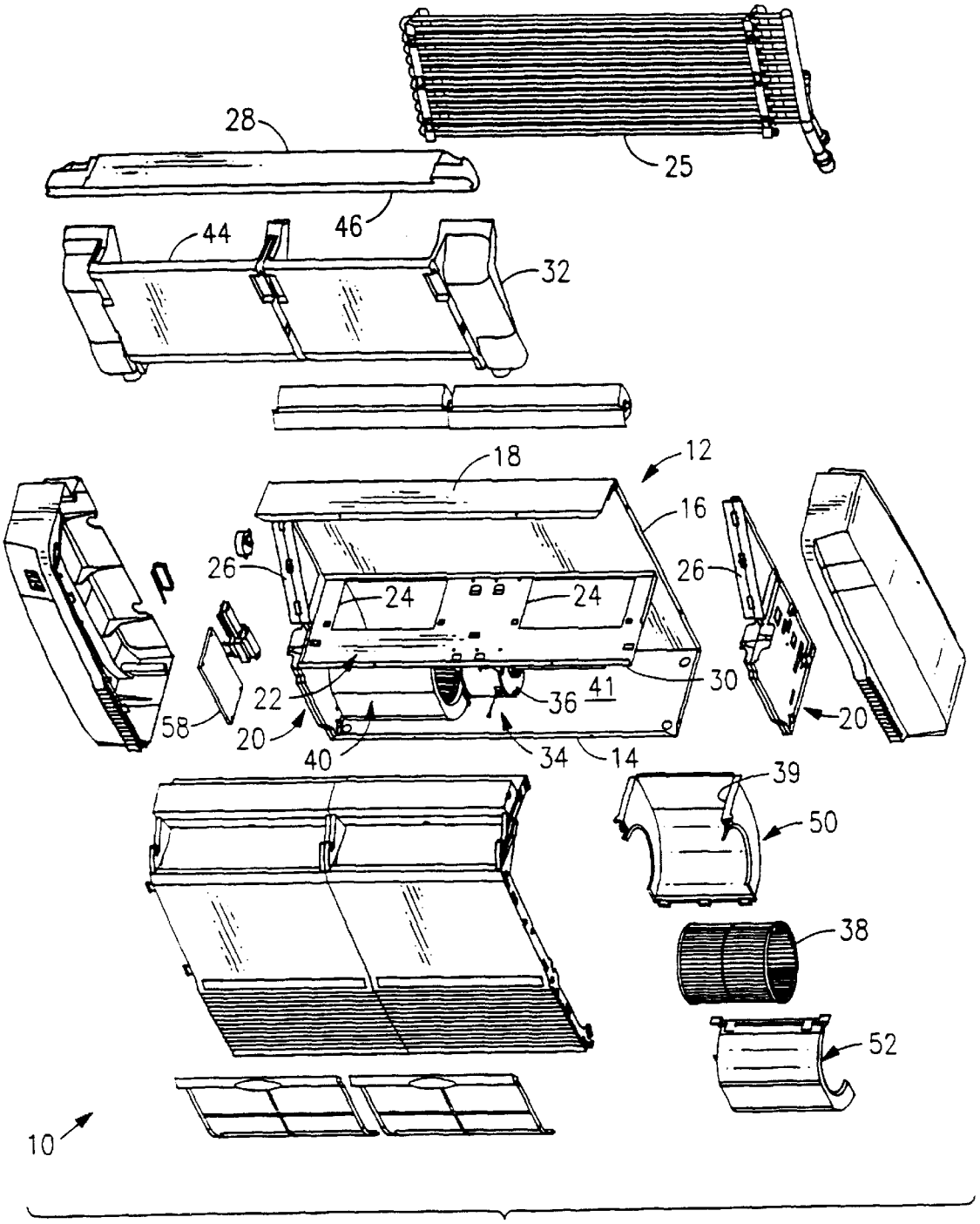
FIG. 8 is a perspective exploded view of the air conditioning unit of FIG. 1.

Looking first at FIGS. 1 and 8, the indoor unit 10 of a split system air conditioning system of the type incorporating a structural framework according to the present invention is illustrated. Briefly, the unit 10 includes a main structural support frame 12, which includes a bottom panel 14, a back panel 16 and a top section 18. Attached to the sides of the back and top panels are structural internal side covers 20. The side covers 20 and the back panel 16 cooperate to support a horizontally extending fan support panel 22, which includes a pair of rectangular openings 24 formed therein. Mounted above the fan support panel 22 on a pair of inclined surfaces 26, defined by the internal side covers 20 is a heat exchanger coil 25.

Mounted under the top section of the main support frame 12 is an upper condensate collection pan 28. Mounted in the front of the unit, under the bottom of the heat exchanger 25, and supported by the front edge 30 of the fan support panel 22, is a lower condensate collection pan 32. A front section of the lower condensate collection pan extends upwardly and is spaced from the heat exchanger coil 25.

Mounted to the lower surface of the fan support panel 22 is a fan assembly 34, which includes an electric motor 36 adapted to drive a pair of centrifugal fans 38, which are each enclosed in a two-piece scroll housing 40. Each of scroll housings 40 defines a rectangular upper air outlet opening 39, which is in air flow communication with the rectangular openings 24 in the fan support panel 22.

As a result of the above-described arrangement of components, when the fan assembly is energized, air is drawn into the region 41 underlying the fan support panel 22 through the open front and is directed upwardly through the rectangular openings 24, through the heat exchanger coil 25 and is discharged through an opening 42 defined by the upper edge 44 of the lower condensate pan 32 and the front edge 46 of the upper condensate pan 28.

During assembly of the air conditioning unit 10, the main structural framework of the unit comprising the structural frame 12 and the internal side covers 20 are first assembled to one another. Following this, a sub-assembly 48, which includes the fan support panel 22 with the fan and motor assembly 34 attached thereto, as well as the two-piece scroll 40 is then assembled to the unit.

Before describing the scroll housing 40 in detail, the sequence of attachment of the components to the fan panel 22 to form the sub-assembly 48 will briefly be described. First, the two pieces of the scroll housing 40 will be referred to as the "back section 50" and the "front section 52". The back section 50 is first attached to the fan panel, as illustrated on the left-hand side of FIG. 5. Following this, an assembly which includes the motor 36 and the fans 38 is attached to the lower side of the fan support panel 22 by a bracket 54. The bracket is attached at a location between the two rectangular openings 24 to thereby support the fans 38 within the back sections 50 of the scroll and underlying the rectangular openings 24. Following this, the front sections 52 of the scrolls are attached to the back sections 50 to complete the sub-assembly 48.

Figure 3:
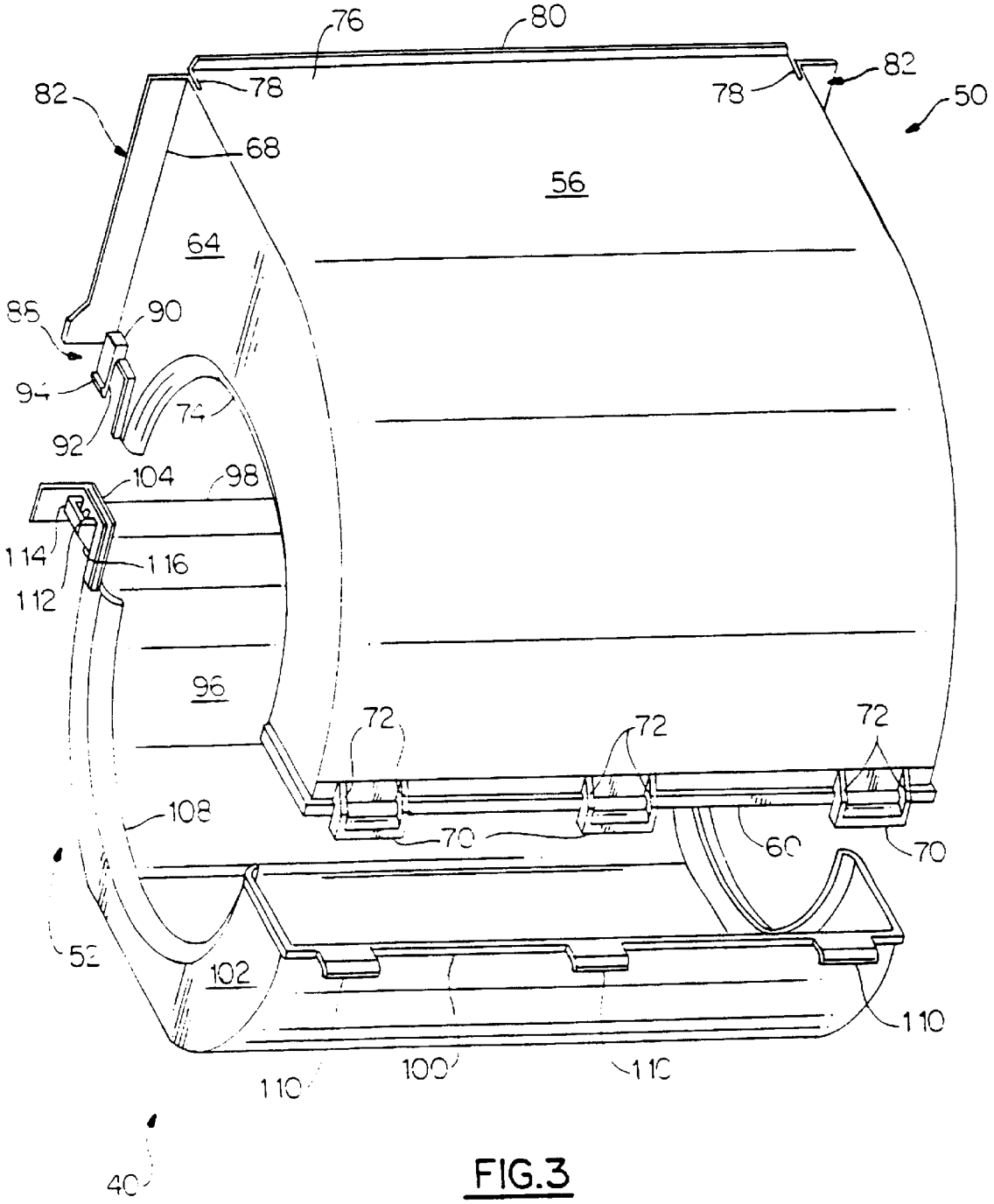
FIG. 3 is a perspective exploded view of the two-piece fan scroll as viewed from the bottom thereof.
Figure 4:
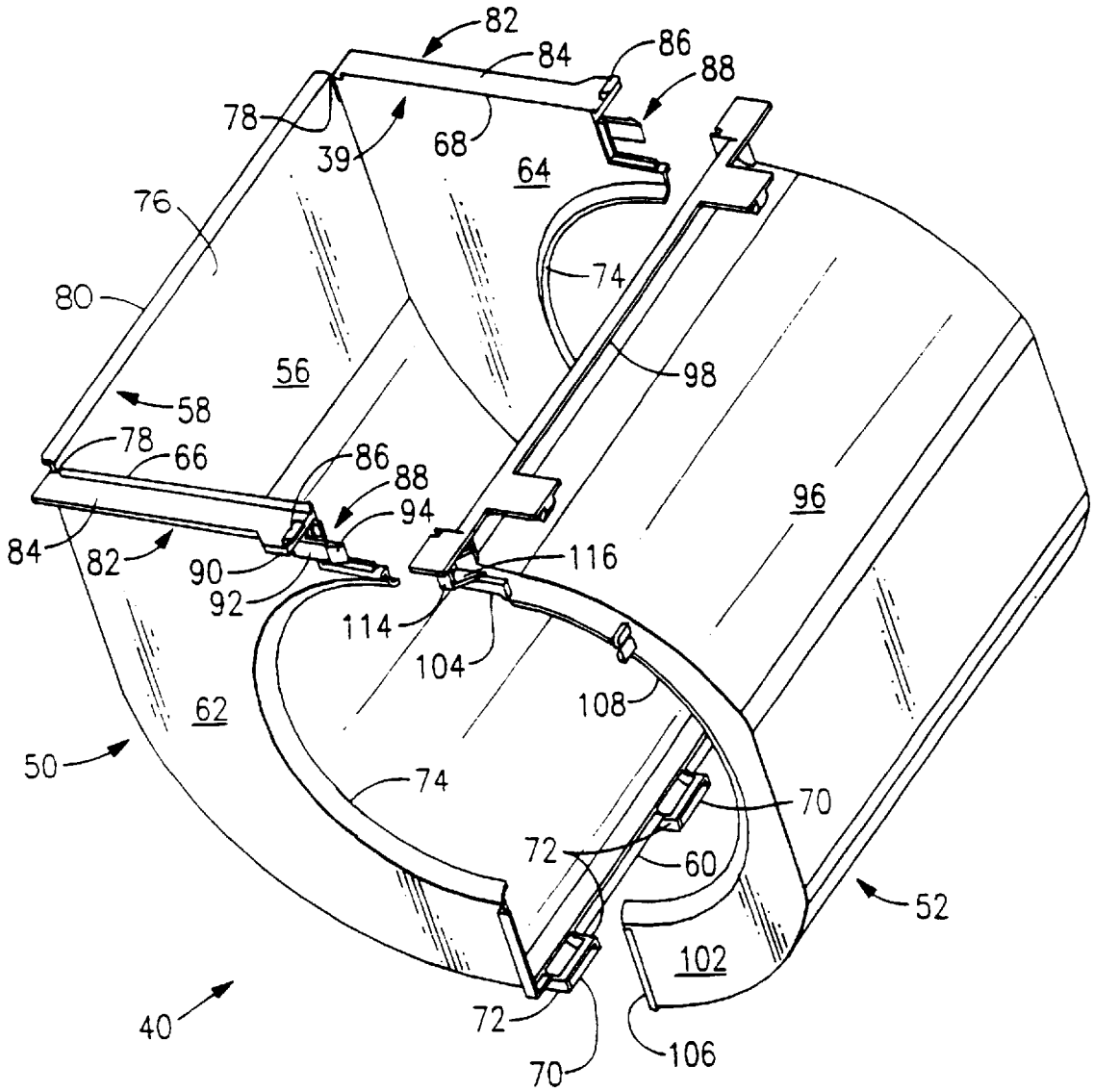
FIG. 4 is a perspective exploded view of the two piece fan scroll as viewed from the top thereof.

FIGS. 3 and 4 illustrate the details of the back and front sections 50 and 52 of the scroll housing in detail. The back section 50 comprises a curved back wall 56, which extends from an upper back edge 58 downwardly and forwardly to a lower front edge 60. Integrally formed with the left and right-hand sides of the back wall 56 are left and right side walls 62 and 64, respectively. Each of the side walls 62 and 64 has an upper edge 66 and 68, respectively, which are perpendicular to and lie in the same plane as the upper back edge 58 of the back wall and together form three sides of the previously referenced air discharge opening 39.

Formed in the lower front edge 60 of the wall 56 are three horizontally extending hinge pins 70. The hinge pins extend along the same axis and are supported in spaced relationship forwardly of the edge 60 by perpendicularly extending structural support sections 72. Each of the side walls 62 and 64 is provided with a semi-circular opening 74 therein which, as will seen, cooperates with a similar opening in the front section 52 to define the inlet openings to the fans 38.

With continued reference to FIGS. 3 and 4, it will be noted that the upper section 76 of the back wall 56, which is adjacent the upper back edge, is separated from the planar end walls at the left and right-hand ends thereof by vertically extending slots 78. Also, extending rearwardly from the upper back edge 58 is a horizontally extending flange 80. The vertical slots 78 are of sufficient length so that the upper section 76 of the wall, which carries the flange 80, may be flexed forwardly when an appropriate force is applied thereto.

Extending laterally outwardly from the upper edges 66 and 68 of the left and right-side walls 62 and 64 are a pair of outwardly extending flanges 82. As is best seen in FIG. 4, these flanges are located at an elevation with respect to the elevation of the flange 80, which is lower than the flange 80 by a distance which is equal to the thickness of the fan support panel 22. Each of the flanges 82 defines an upwardly facing surface 84 and is provided with an L-shaped latch 86 formed thereon at the end opposite the upper back edge 58. The L-shaped latches 86 face forwardly, i.e. in a direction opposite from that of the flange 80 formed on the wall 58 and the L-shaped latches extend above the flange on which they are formed by the thickness of the fan support panel 22.

Each of the left and right side walls 62 and 64 is provided with a flexible latch element 88 formed at the upper end thereof underlying the flanges 82 and overlying the upper end of the semi-circular opening 74. Each of the flexible latches extends forwardly and has a fixed end 90 molded into the side wall, a flexible latch section 92 and latching head 94 at the free end thereof.

The front section 52 of the scroll housing includes a curved wall 96, which has an upper back edge 98 and a lower back edge 100. The curved wall 96 further includes planar end walls 102 on opposite sides thereof. Each of the end walls 102 has a first edge 104 which intersects with and is perpendicular to the upper back edge 98 of the curved wall and a second edge 106, which intersects with and is perpendicular to the lower back edge 100 of the curved wall. Each of the end walls 102 is provided with a semi-circular opening 108 therein which, as previously described, cooperates with the semi-circular opening 74 in the back section 50 when the scroll 40 is assembled to define the air inlet openings. As best seen in FIG. 3, the lower back edge 100 is provided with three integrally formed hooks 110, which are configured to engage the three hinge pins 70 carried by the back section 50 in a manner which will be described.

Located in the edges 104 underlying the upper back edge 98 are substantially rectangular horizontally extending openings 112, which are adapted to receive the latch heads 94 and a portion of the flexible section 92 of the flexible latches 88 carried by the back section 50. The latch openings 112 are configured to allow the latch heads 94 to engage structure 114 surrounding the opening and to be flexed to a deformed position to allow the enlarged heads 94 to pass therethrough. Once the latch heads 94 pass through the openings 112, the latches are allowed to return to their undeformed position with the latch heads 94 engaging structure 116 on the exit side of the openings to positively retain the back and front sections 50 and 52 to one another.

Looking back now at the previously described assembly sequence, the back section 50 of the scroll 40 is assembled to the fan panel 22 by extending the flange 80 carried at the upper back edge 58 into the opening 24 in the fan panel and engaging it with the rear edge of the opening. Following such engagement, sufficient force is imparted upon the back section 50 to cause the upper section 76 of the back wall 56 to flex thereby allowing the entire back section 50 to move rearwardly a sufficient amount to allow the latch sections 86 carried on the top surface 84 of the side wall flanges 82 to pass through mating openings 118 provided in the fan panel 22. Once the latch elements 86 have passed through the openings 118, the top surface 84 of the flanges 82 will be in confronting relation with the bottom of the fan panel 22 and the force causing deformation of the back wall is released and the latches 86 will be displaced forwardly to engage the upper surface of the fan panel 22 thereby cooperating with the flange 80 to thereby attach the back section 50 of the scroll 40 the fan panel 22.

Following such assembly, the motor and fan assembly is attached to the fan panel by way of the bracket 54, as described above.

Figure 5:
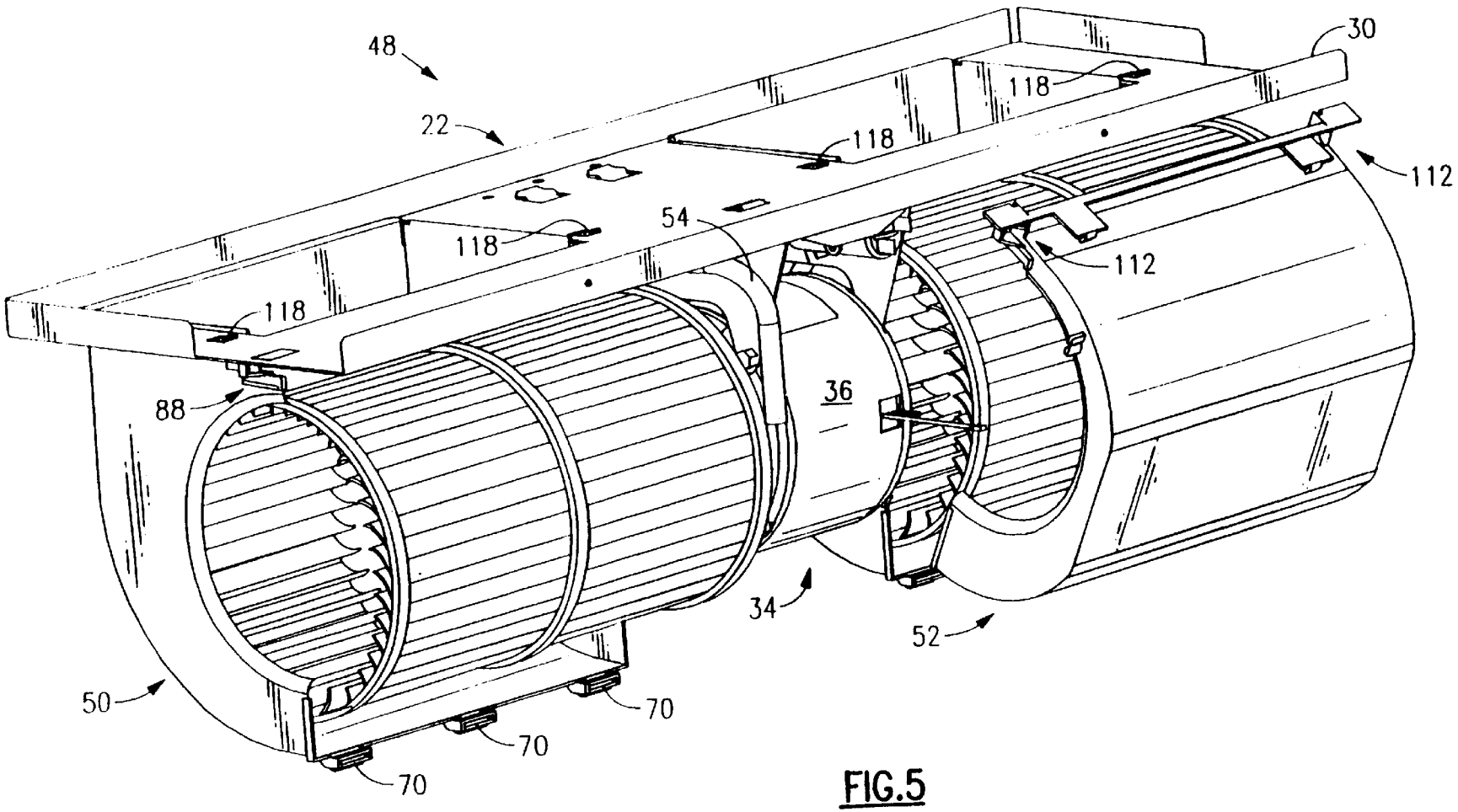
FIG. 5 illustrates a partially assembled sub-assembly of the fan panel, fans and fan scrolls of the unit of FIG. 1.
Figure 6:
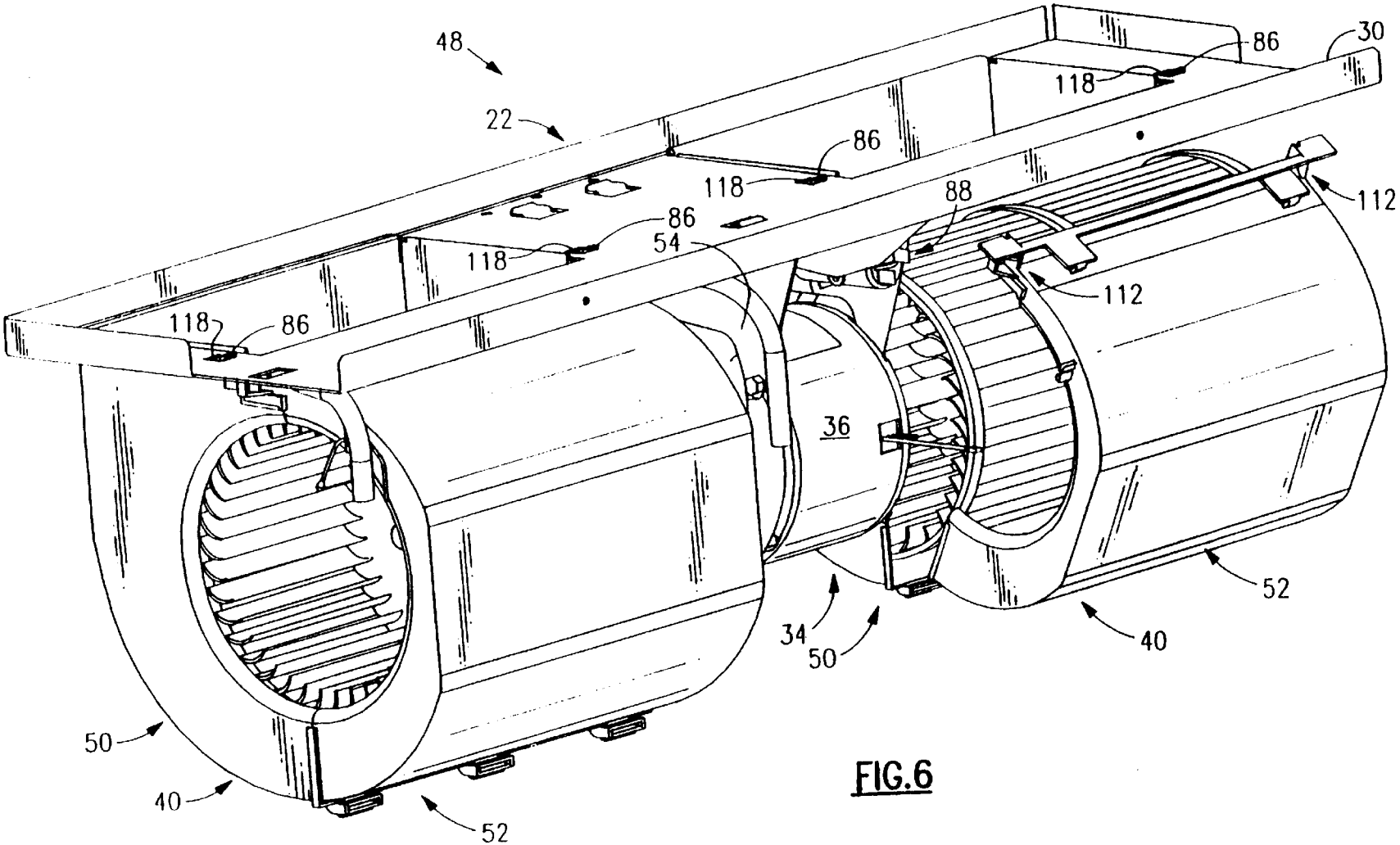
FIG. 6 is a view similar to FIG. 5 with one scroll fully assembled.
Figure 7:
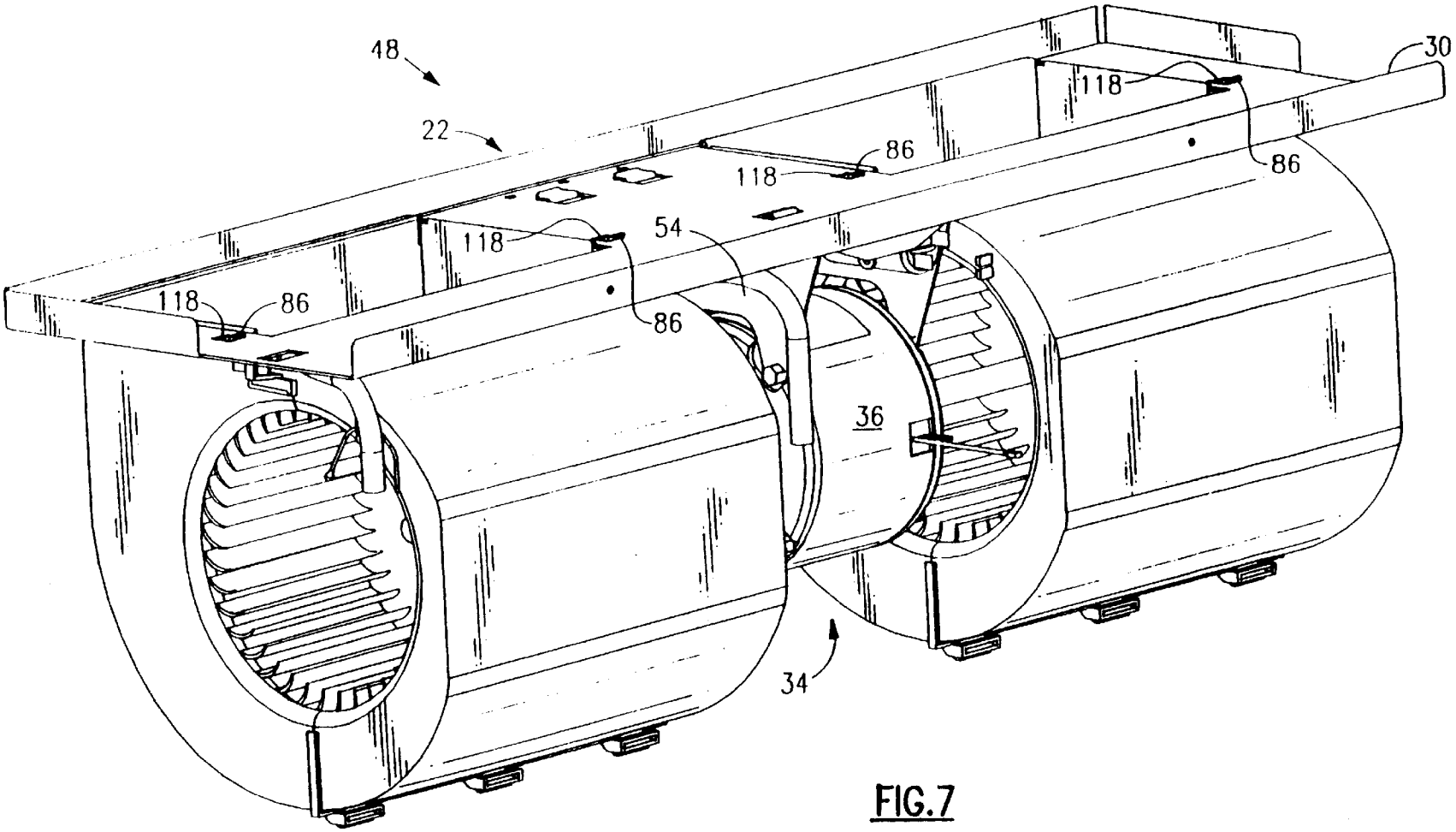
FIG. 7 is a fully assembled view of the sub-assembly of the fan panel, fans and fan scrolls of the unit of FIG. 1.

Completion of sub-assembly 48 is then carried out by engaging the hooks 110 carried by the front scroll sections 52 with the mating hinge pins 70 in the back section 50, as illustrated in the right-hand side of FIG. 5. Following such engagement, the upper part of the front section 52 is rotated rearwardly about the hinged engagement between the pins 70 and the hooks 110 to thereby cause the flexible latches 88 of the back sections 50 to be received in the mating latching openings 112 in the front sections 52 in the manner described above.

As thus assembled, the two-piece scroll housing has been assembled to the fan panel and the front and rear sections 50 and 52 assembled to one another without the necessity for any separate fastening elements and without incurring the labor involved in manipulating such fastening elements.

What is claimed is:

1. A scroll housing for enclosing a centrifugal fan of an air distribution unit, said housing being of the type configured for mounting to a panel dividing the air distribution unit into an inlet and outlet region, the panel having a rectangular opening therein, said scroll housing defining an irregular cylinder having end walls with circular inlet openings therein and a rectangular opening configured to be in air flow communication with said rectangular opening in said panel, wherein the improvement comprises:

said scroll housing being formed from two sections;

said first section including a curved wall having a first edge at one end thereof defining a side of said rectangular opening, and a second edge at the other end thereof, said first and second edges being substantially parallel to one another;

said first section further including planar end walls on opposite sides of said curved wall, each of said end walls having a first edge intersecting with and substantially perpendicular to said first edge of said curved wall to thereby define lateral sides of said rectangular opening, and a second edge intersecting with said second edge of said curved wall; and a semi-circular opening forming half of said circular inlet opening;

said second section including a curved wall having a first edge, at one end thereof, defining the fourth side of said rectangular opening and a second edge at the other end thereof;

said second section further including planar end walls on opposite sides of said curved wall, each of said end walls having a first edge intersecting with and perpendicular to said first edge of said curved wall, and a second edge intersecting with and substantially perpendicular to said second edge of said curved wall; and a semi-circular opening forming half of said circular inlet opening;

said second edge of said curved wall of said first section having a first hinge element formed thereon;

said second edge of said curved wall of said second section having a second hinge element formed thereon, said first and second hinge elements being configured to be engaged with one another to interconnect said second edges of said first and second sections and allow pivotal movement of said first and second sections with said sections moving toward one another;

said side walls of said first section having a latching conformation formed thereon at a location underlying said first edge thereof and above said semi-circular opening therein;

said side walls of said second section having a latching conformation formed thereon in said first edge thereof which are adapted to positively engage said latching conformations on said first section when said sections are pivoted toward one another about said hinged engagement.

2. The apparatus of claim 1 wherein said one end of said curved wall of said first section includes a section thereof which is not connected to said planar end walls and wherein said section is configured so that it may flex with respect to said curved wall; and wherein said first edge of said flexible section comprises a longitudinally extending rearwardly facing flange; and wherein each of said planar end walls further include an outwardly extending, substantially perpendicular flange adjacent to and underlying said flange formed on said first edge by a predetermined dimension;

each of said flanges of said planar wall sections having an L-shaped latch formed thereon at the end opposite said first edge of said curved wall, said latch is facing in a direction opposite that of said flange formed on said first edge of said curved wall and extending above said flanges on which they are formed by said predetermined distance; and wherein said predetermined distance is substantially equal to the thickness of said air distribution unit panel, and wherein each of said rectangular openings in said panel comprises a first edge substantially equal in length to said first edge of said curved wall of said first section and includes lateral sides extending perpendicular thereto, said panel including openings therein adjacent each of said lateral sides which are spaced from the first side of said opening by a distance equal to the distance from said one end of said curved wall to the location of said latch elements;

whereby said first section may be assembled to said panel by engaging said flange on said first edge of said curved wall with said first side of said opening in said panel and imparting a force on said first section to flex said free wall portion of said curved wall to thereby cause said latching elements to move into engagement with said openings in said panel to thereby positively attach said first section to said panel when the installation force is removed therefrom.

3. The apparatus of claim 2 wherein said latching conformation of said side wall of said first section and said latching conformation of said side walls of said second section are all configured to lie under the panel to which the scroll is attached whereby said second section of said scroll housing may be attached to said first section following installation of said first section to said panel.

* * * * *